US008610036B2

(12) United States Patent
Ewell, Jr. et al.

(10) Patent No.: US 8,610,036 B2
(45) Date of Patent: Dec. 17, 2013

(54) DEVICE AND METHOD FOR MONITORING A HEATING APPLIANCE

(76) Inventors: Robert C. Ewell, Jr., Ballston Spa, NY (US); Douglas L. Garmany, Pineland, TX (US); Charles T. Kelly, Houston, TX (US); Charles Philip Wasilewski, Great Falls, MT (US)

( * ) Notice: Subject to any disclaimer, the term of this patent is extended or adjusted under 35 U.S.C. 154(b) by 387 days.

(21) Appl. No.: 12/909,902

(22) Filed: Oct. 22, 2010

(65) Prior Publication Data

US 2012/0097662 A1 Apr. 26, 2012

(51) Int. Cl.
*H05B 1/02* (2006.01)

(52) U.S. Cl.
USPC ..... 219/492; 219/497; 219/506; 219/483; 219/412; 219/448.11; 99/332; 99/344; 340/870.17

(58) Field of Classification Search
CPC ..... H05B 1/02
USPC ..... 219/445.1, 448.11, 448.12, 412, 413, 219/446, 1, 481, 483–487, 494, 497, 506; 340/870.17, 870.16, 573.1, 588, 686.6, 340/FOR. 103; 99/332, 337, 342, 344; 431/13, 75
See application file for complete search history.

(56) References Cited

U.S. PATENT DOCUMENTS

| | | | | |
|---|---|---|---|---|
| 4,782,420 | A | 11/1988 | Holdgaard-Jensen | |
| 5,318,224 | A * | 6/1994 | Darby et al. | 236/47 |
| 5,541,579 | A | 7/1996 | Kiernan | |
| 5,608,383 | A * | 3/1997 | Neil | 340/588 |
| 5,628,242 | A | 5/1997 | Higley | |
| 5,717,188 | A | 2/1998 | Vaillancourt | |
| 5,734,206 | A | 3/1998 | Keizer et al. | |
| 5,796,346 | A | 8/1998 | Wash et al. | |
| 5,805,767 | A * | 9/1998 | Jouas et al. | 392/373 |
| 5,909,378 | A * | 6/1999 | De Milleville | 700/276 |
| 5,945,017 | A | 8/1999 | Cheng et al. | |
| 6,013,901 | A * | 1/2000 | Lavoie | 219/435 |
| 6,130,413 | A | 10/2000 | Rak | |
| 6,294,994 | B1 | 9/2001 | Hoellerich | |
| 6,411,215 | B1 | 6/2002 | Shnier | |
| 7,002,109 | B2 | 2/2006 | Klask | |
| 7,005,986 | B2 | 2/2006 | Parks, III et al. | |
| 7,802,618 | B2 * | 9/2010 | Simon et al. | 165/254 |
| 2009/0017404 | A1 | 1/2009 | White et al. | |

* cited by examiner

*Primary Examiner* — Mark Paschall
(74) *Attorney, Agent, or Firm* — Schmeiser, Olsen & Watts

(57) ABSTRACT

A device for monitoring a heating apparatus that includes a default deactivated motion detector for determining whether a person is proximate the heating apparatus. The device includes a default deactivated heat sensor for determining whether the heating apparatus has a temperature that is above a threshold. The device includes an internal timer for cyclically repeating a first countdown. The heat sensor is temporarily activated once during each of the repeated first countdowns. The internal timer performs a second countdown when the activated heat sensor determines that the heating apparatus has the temperature that is above the threshold. The second countdown is reset each time the motion detector determines that a person is proximate the heating apparatus. The device includes an alarm configured to notify a user when the internal timer reaches the end of the second countdown.

18 Claims, 4 Drawing Sheets

DEVICE AND METHOD FOR MONITORING A HEATING APPLIANCE

FIELD OF THE INVENTION

The subject matter disclosed herein relates generally to a device and method for monitoring a heating appliance. More particularly, the subject matter relates to a device and method for alerting a user when a heating appliance is on and left unattended.

BACKGROUND OF THE INVENTION

Heating appliances such as stoves, ovens, grills, fryers, and the like should be monitored regularly when in use. Forgetting about a heating appliance may result in an over cooked meal. However, an overcooked meal may be a minor concern when compared with the potential safety hazard caused by leaving a heating appliance unattended. This is because items left on the stove, oven, grill, fryer, and the like may overheat, resulting in the production of smoke and fire. In such a situation, a standard fire alarm may not alert a user until after flames have already ignited. This is because fire alarms typically sense the presence of smoke, which is an immediate precursor to a fire. As a result, heating appliances can be extremely dangerous to an unwary and forgetful user.

Thus, a device and method for alerting a user when a heating appliance is on and left unattended would be well received in the art.

BRIEF DESCRIPTION OF THE INVENTION

According to one aspect, a device for monitoring a heating apparatus comprises: a motion detector configured to determine whether a person is proximate the heating apparatus, wherein the motion detector is default deactivated; a heat sensor configured to determine whether the heating apparatus has a temperature that is above a threshold, wherein the heat sensor is default deactivated; an internal timer configured to cyclically repeat a first countdown, and wherein the heat sensor is temporarily activated once during each of the repeated first countdowns, and wherein the internal timer is configured to perform a second countdown when the activated heat sensor determines that the heating apparatus has the temperature that is above the threshold, and wherein the second countdown is reset each time the motion detector determines that a person is proximate the heating apparatus; and an alarm configured to notify a user when the internal timer reaches the end of the second countdown.

According to another aspect, a method for monitoring a heating apparatus comprises: repeating a first countdown of a first set period with a timer; activating a heat sensor at the end of each of the repeated first countdowns, the heat sensor configured to determine whether the heating apparatus has a temperature that is above a threshold; detecting motion with a motion sensor when the heat sensor determines that the heating apparatus has a temperature that is above the threshold; performing a second countdown of a second set period with the timer; resetting the second countdown when motion is detected by the motion sensor; and alarming a user with an alarm when the timer reaches the end of the second countdown.

According to yet another aspect, a device for monitoring a heating apparatus comprises: a motion detector configured to determine whether a person is proximate the heating apparatus; a heat sensor configured to determine whether the heating apparatus has a temperature that is above a threshold; an internal timer configured to cyclically repeat a first countdown, and wherein the heat sensor is temporarily activated at least once during each of the repeated first countdowns, and wherein the internal timer is configured to perform a second countdown when the activated heat sensor determines that the heating apparatus has the temperature that is above the threshold, and wherein the second countdown is reset each time the motion detector determines that a person is proximate the heating apparatus; and an alarm configured to notify a user when the internal timer reaches the end of the second countdown; and wherein the internal timer is configured to stop the second countdown and revert back to the first countdown when the heat sensor determines at least one of: that the temperature is below the threshold; and that the temperature of the heating apparatus is steadily declining.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
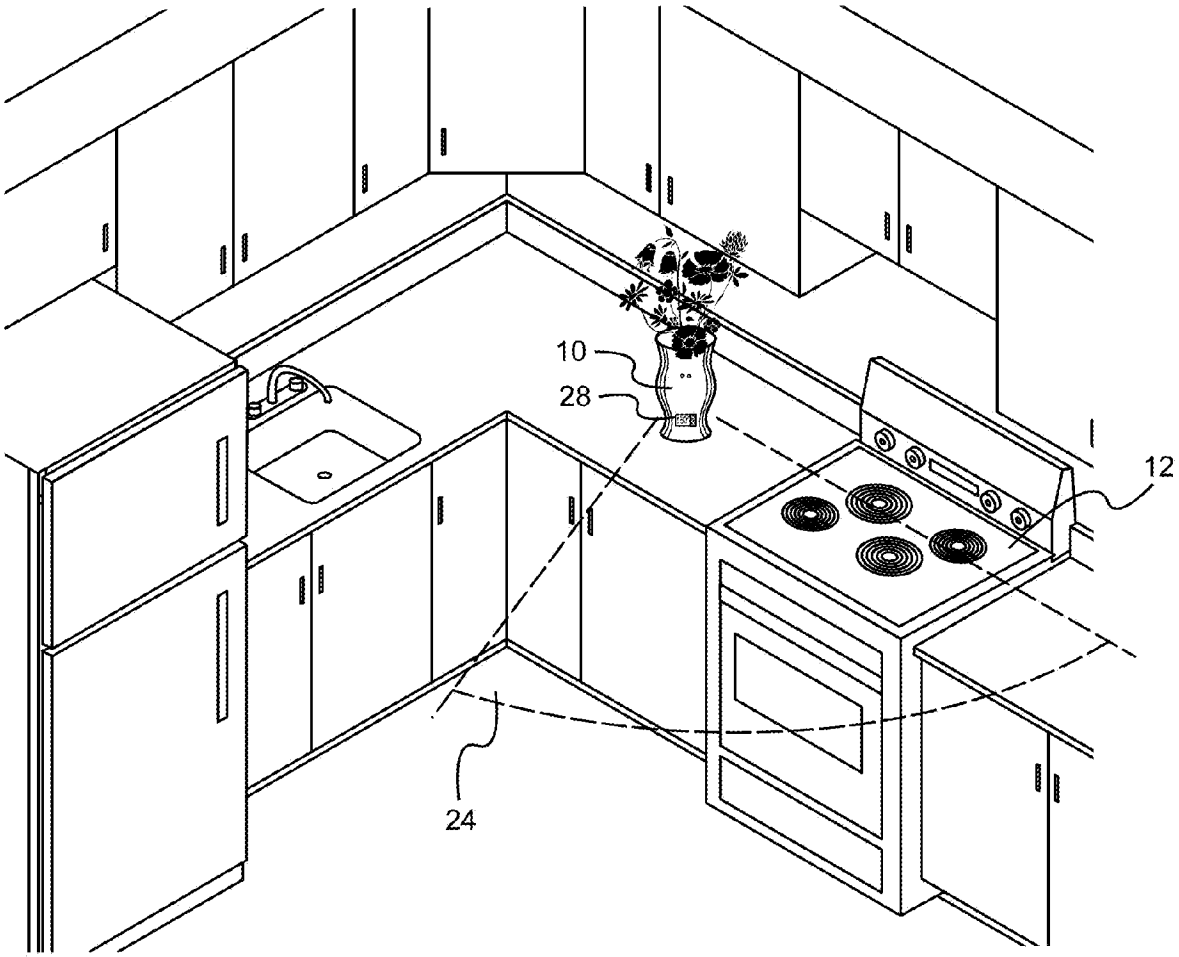
FIG. 1 depicts a perspective view of a device located on a countertop in proximity of a stove top in accordance with one embodiment.
Figure 2:
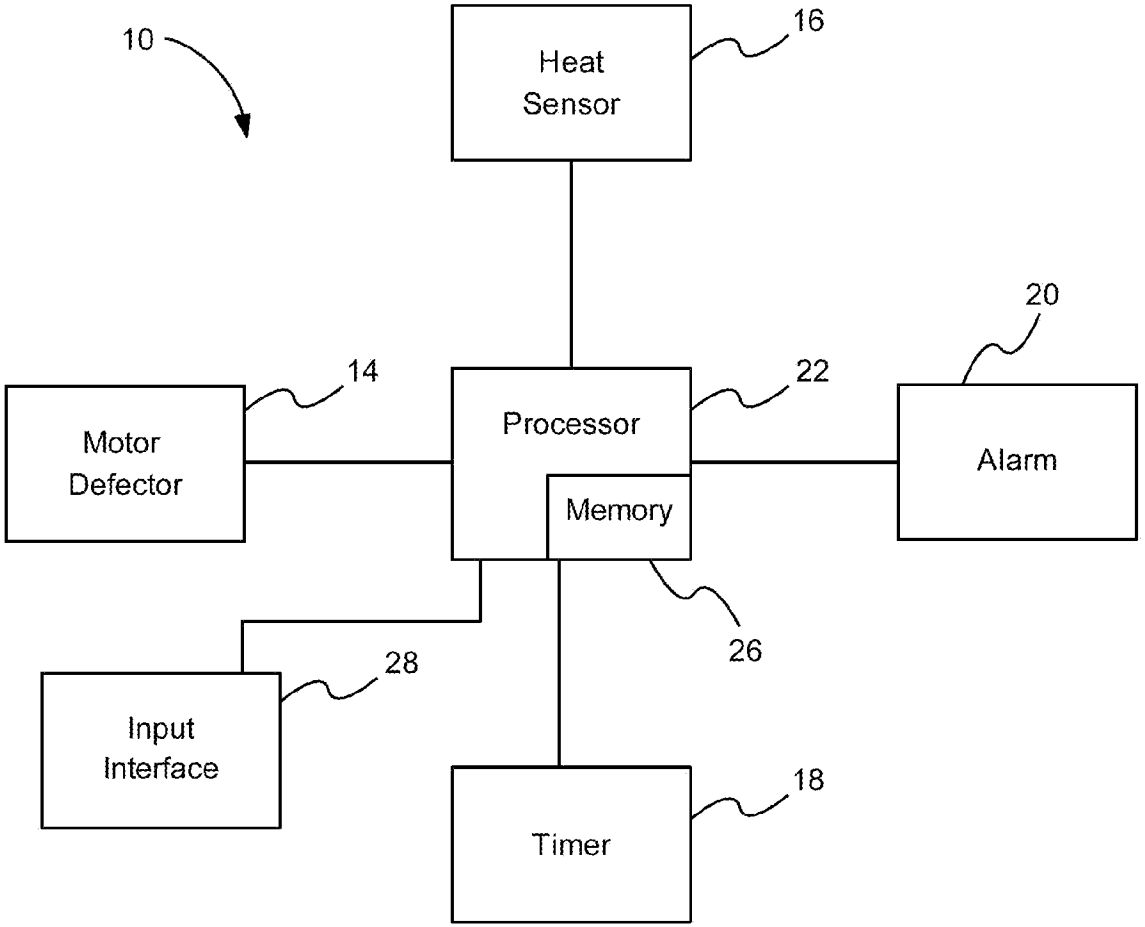
FIG. 2 depicts a schematic view of the device for monitoring the heating appliance of FIG. 1 in accordance with one embodiment.
Figure 3:
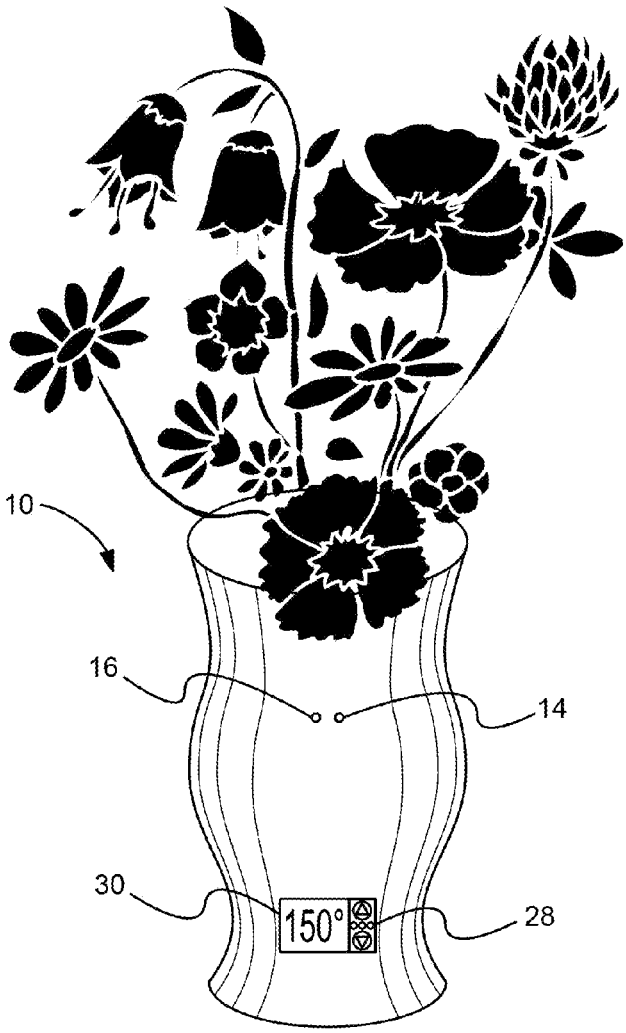
FIG. 3 depicts a perspective view of the device of FIG. 1 in accordance with one embodiment.

Referring firstly to FIGS. 1-3, there is shown a device 10 for monitoring a heating apparatus 12. While the heating apparatus 12 may be a stove as shown in FIG. 1, other heating apparatuses are contemplated. For example, it should be understood that the device 10 may be configured to monitor ovens, grills, fryers, or the like. The device 10 may be encased into a typical kitchen apparatus, such as flower vase as shown in the Figures. However, other kitchen apparatuses are contemplated such as spice racks, knife holders, utensils, clocks, coffee makers, tea pots, or the like. It should be understood that any apparatus that would typically be used, or look natural, on a countertop is contemplated. Alternately, the device 10 may be hangable from a ceiling. In this embodiment, the device 10 may be integrated into a hanging light or fan, for example. Furthermore, the device 10 may simply be attachable or integrated into the heating appliance 12 itself. The device 10 includes a motion detector 14, a heat sensor 16, a timer 18, an alarm 20, and a processor 22 that work in conjunction to alert a user that the heating appliance 12 has been left unattended. The device 10 is placeable in the proximity of the heating apparatus 12 such that the heat sensor 16 is able to detect the temperature of the heating appliance 12 and the motion detector 14 is able to detect movement in a proximity area 24 of the heating appliance 12. It should be understood that embodiments of the device 10 may be battery powered, solar powered, or may be plugged in to an outlet.

The motion detector 14 may further be deactivated by default. This may be advantageous in order to conserve energy that is used by the device 10 or battery life of the device 10. The motion detector 14 may be an infrared sensor, or any type of sensor that is able to detect whether a user is in the proximity of the heating apparatus 12. The motion detector 14 may be particularly configured to detect motion only in an area 24 proximate the heating appliance 12. Thus, the motion detector 14 may be able to detect that a user has walked by or maintaining a presence at the heating appliance 12 and is presumably aware of the temperature and heating state of the heating appliance 12. The motion detector 14 may be able to distinguish this proximate motion at the heating appliance 12 with other movements that occur at farther distances from the heating appliance 12. This is because movement occurring too far from the heating appliance 12 may not indicate that the user is currently aware of the temperature and heating state of the heating appliance 12. In one embodiment, the motion detector 14 may simply not be able to detect motion that occurs at a location that is farther than a predetermined distance. Alternately, the processor 22 may be able to distinguish this proximate movement from the movement occurring at a predetermined distance from the heating appliance 12. Furthermore, the motion detector 14 may be able to distinguish the height at which the movement occurs. The motion detector 14 may be configured to not detect motion that is below a certain height so that the device 10 can distinguish between children and adults in the vicinity of the heating appliance 12. Alternately, the motion detector 14 can sense motion at any height and the processor 22 may distinguish that motion of a certain height means that a user is currently aware of the heating appliance 12. While the embodiment depicted includes a single motion detector 14, it may be beneficial to include a plurality of motion detectors. For example, a plurality of motion detectors 14 may be able to detect in a broader area of space around the proximity of the heating apparatus 12.

Like the motion detector 14, the heat sensor 16 may also be deactivated by default. Again, this may be advantageous in order to conserve energy that is used by the device 10 or battery life of the device 10. The heat sensor 16 may be an infrared sensor, or any other sensor known to those skilled in the art that can make an exact or approximate determination of the temperature of an object or the amount of heat radiating from an object. In one embodiment, the heat sensor 16 and the motion detector 14 may be the same sensor. Thus, the heat sensor 16 may also detect motion in the vicinity of the heating apparatus 12. However, in the embodiment depicted, the device 10 includes two separate sensors 14, 16 to motion and heat respectively. While the embodiment depicted includes a single heat sensor 16, it may further be beneficial to include a plurality of each of these detection mechanisms. For example, a plurality of heat sensors 16 may be able to detect in a broader area of space.

The timer 18 may be configured to cyclically repeat a first countdown. At the end of the first countdown, the heat sensor 16 may be activated temporarily in order to sense heat being emitted from the heating apparatus 12. The period of the first countdown may be, for example, 10 minutes. Other periods are contemplated. For example, the period of the first countdown may be between five minutes and thirty minutes. The period of the first countdown should be set such that the heating apparatus 12 may be on for this length of time without being hazardous. The timer 18 is configured to perform a second countdown when the activated heat sensor 16 determines that the heating apparatus 12. The second countdown may have the same period as the first countdown, or a different period, depending on the embodiment. When the second countdown is being performed, the motion detector 14 may be activated. When motion is detected, the second countdown may be reset such that the period must be re-counted. This resetting may continue each time motion is detected by the motion detector 14. However, if the second countdown reaches the end without any detected motion, the alarm 20 may be configured to notify a user that the heating apparatus 12 is left unattended.

It should be understood that the alarm 20 may be an audible alarm. Thus, the device 10 may include one or more speakers so that the alarm is loud enough to alert a user that may be in another room from the heating appliance 12. The audible waves of the alarm may have a frequency and amplitude of a typical fire alarm. However, other embodiments are contemplated. For example, the alarm 20 may also be a visual alarm. This may be particularly beneficial when a user is hearing impaired. Of course, the alarm 20 may include both audible and visual components. Furthermore, the device 10 may send a signal to an off-site remote alarm (not shown) in addition to the integrated alarm 20. The off-site alarm may be an alarm similar to the alarm 20 in another room of the house than the room that the device 10 is in. For example, the device may send a signal to an off-site alarm in a study or living room. Furthermore, the off-site remote alarm may signal to a user that is located completely out of the house that the heating apparatus 12 is located. For example, the device 10 may be configured to automatically notify a user's cell phone, computer, telephone or any other device. In the case that the device 10 contacts a user's cell phone to alarm the user, the user may be required to download an application that allows for communication with the device 10 in order to alarm the user in a similar manner to the alarm 20 as described herein above.

Furthermore, the timer 18 may be configured to stop the second countdown and revert back to the initial first countdown when the heat sensor 16 determines that the temperature is back below the threshold. Thus, the heat sensor 16 may be active during the second countdown, either continuously or temporarily at intervals. Furthermore, even if the heat sensor 16 determines that the temperature is above the threshold, the timer 18 may be configured to stop the second countdown and revert back to the first countdown when the heat sensor 16 determines that the temperature of the heating apparatus 12 is steadily declining. This may signal to the device 10 or the processor 22 that the heating appliance 12 is turned off and may prevent the alarm 20 from inadvertently notifying a user in such a situation.

Shown in FIG. 2 is a schematic view of the device 10 including the motion detector 14, the heat sensor 16, the timer 18, the alarm 20 and the processor 22. Any or all of the motion detector 14, the heat sensor 16, the timer 18, the alarm 20 and the processor 22 may be located within the housing of the device 10. As shown, the operations of the timer 18 in conjunction with the heat sensor 14, the motion detector 16, and the alarm 20, as described hereinabove, may be controlled and directed by the processor 22. It should further be understood that the device 10 may also include memory 26 that is connected to the processor 22 for storing the programming to perform the functions described hereinabove. Alternately or in addition to the memory 26, the device 10 may also be controlled through firmware that is embedded into the device 10 or the processor 22.

Referring more specifically to FIG. 3, the device 10 may include an input interface 28. The input interface 28 may allow a user to change the period of least one of the first countdown and the second countdown. Thus, the input interface 28 may include a user display 30 for displaying the settings to the user. The input interface 28 may be a simple toggle that provides for the shortening or extension of either or both of the countdowns. For example, the user interface 28 includes up and down arrows for increasing or decreasing the numerical value inputs. Other functions of the device 10 may also be altered by a user through the input interface 28. For example, the threshold temperatures described hereinabove may also be toggled. Thus, low simmering temperatures may be prevented from triggering the device 10 from entering into the second countdown. The input interface 28 may or may not include an on/off switch for the device 10. In one embodiment, for example, there may not be an on/off switch for the device 10 because the device 10 is always in an "on" state as long as it is plugged in, has charged batteries, or is otherwise powered. In this "on" state there may be no way to deactivate the device 10, other than unplugging, removing batteries, or otherwise unpowering the device 10. Furthermore, this "on" state should not be meant to imply that the heat sensor 16 and the motion detector 14 are always "on" but rather that the internal timer 18 is performing its countdowns and turning the heat sensor 16 and the motion detector 14 "on" at various intervals as described herein.

Figure 4:
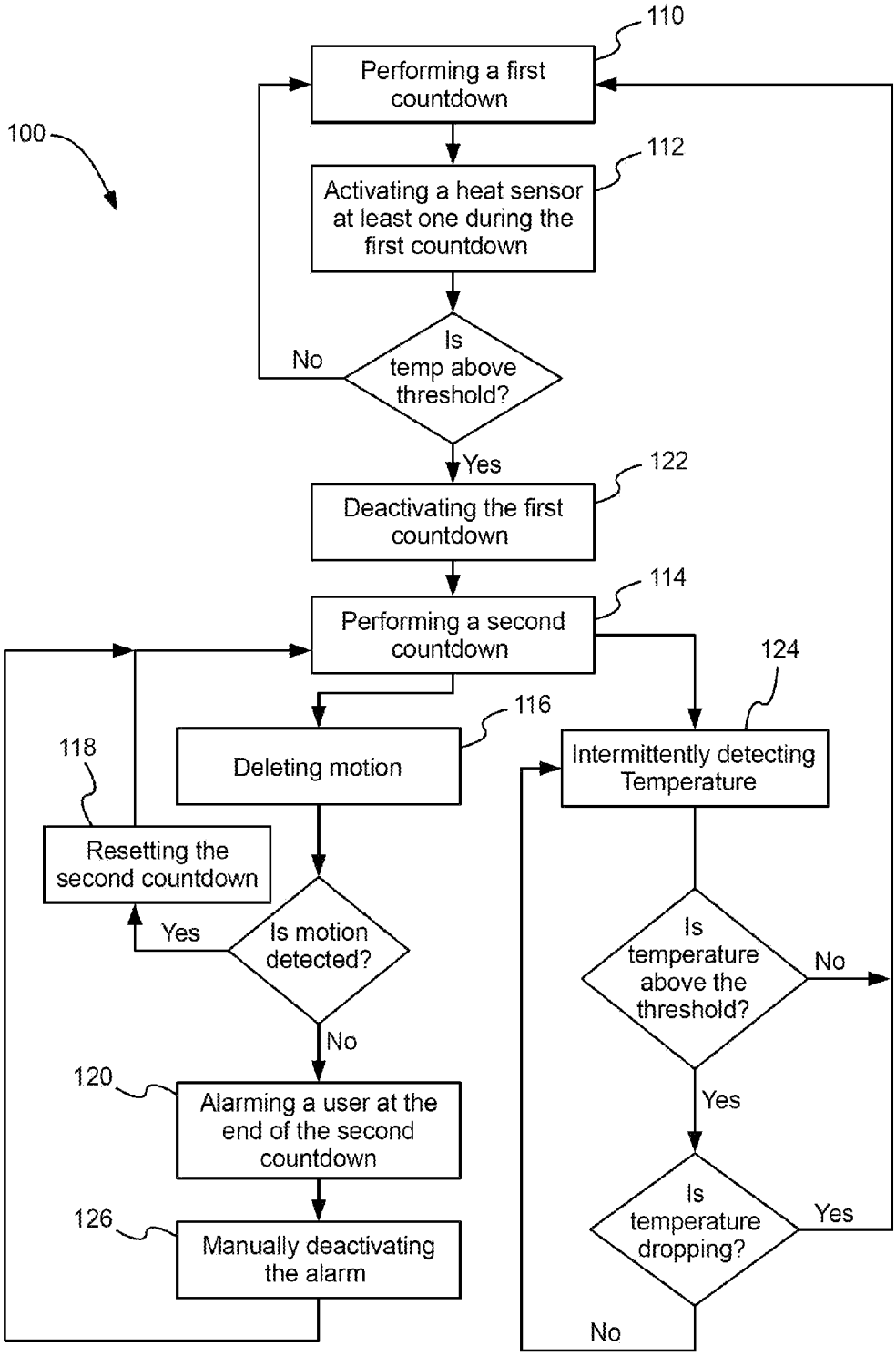
FIG. 4 depicts a flow diagram of a method for monitoring a heating appliance in accordance with one embodiment.

Referring now to FIG. 4, a flow diagram of a method 100 for monitoring a heating appliance, such as the heating appliance 12, is shown. The method 100 first includes a step 110 of performing a first countdown of a first set period with a timer, such as the timer 18. The method 100 then includes a step 112 of activating a heat sensor, such as the heat sensor 14, once during each of the repeated first countdowns. The heat sensor may be configured to determine whether the heating apparatus has a temperature that is above a threshold. If the heat sensor determines that the heat is below the threshold, the first countdown is repeated. If the heat sensor determines that the heat is above the threshold, the method 100 may then proceed to a step 114 of performing a second countdown of a second set period with the timer.

During the second countdown, the method 100 includes a step 116 detecting motion with a motion sensor, such as the motion sensor 16, when the heat sensor determines that the heating apparatus has a temperature that is above the threshold. Next, the method 100 includes a step 118 of resetting the second countdown when motion is detected by the motion sensor. The method 100 then involves a step 120 of alarming a user when the timer reaches the end of the second countdown. It should be understood that the method 100 may further include providing a single device for housing the heat sensor, the timer, the motion sensor and the alarm. Further, the method 100 may include a step 126 of manually deactivating the alarm by a user. The method 100 may further include a step 122 of deactivating the first countdown of the timer when the timer is performing the second countdown.

Furthermore, the method 100 may include a step 124 of intermittently detecting the temperature of the heating apparatus with the heat sensor during the second countdown. It should be understood that the intermittent temperature detection may have the same countdown period as the first countdown period. Further, the intermittent detecting step 124 may be being performed by the method 100 during the detecting motion step 116 during the second countdown. Furthermore, the method 100 may include a step 126 of reverting back to the first countdown if it is determined that either: (1) the temperature is below the threshold; or (2) that the temperature is decreasing, as described hereinabove. If the temperature remains above the threshold and the temperature is not dropping, the step of intermittently detecting temperature 124 may continue.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A device for monitoring a heating apparatus comprising:

a motion detector configured to determine whether a person is proximate the heating apparatus, wherein the motion detector is default deactivated;

a heat sensor configured to determine whether the heating apparatus has a temperature that is above a threshold, wherein the heat sensor is default deactivated;

an internal timer in operable communication with the motion detector and the heat sensor, the internal timer configured to cyclically repeat a first countdown, and wherein the heat sensor is temporarily activated once during each of the repeated first countdowns, and wherein the internal timer is configured to perform a second countdown when the activated heat sensor determines that the heating apparatus has the temperature that is above the threshold, and wherein the second countdown is reset each time the motion detector determines that a person is proximate the heating apparatus; and an alarm in operable communication with the internal timer, the alarm configured to notify a user when the internal timer reaches the end of the second countdown.

2. The device of claim 1, wherein the heat sensor is an infrared sensor.

3. The device of claim 1, wherein the alarm is an audible alarm.

4. The device of claim 1, wherein the device is encased into a kitchen apparatus with a secondary use, wherein the kitchen apparatus is selected from the group consisting of a knife holder, a spice rack, a utensil, a clock, a coffee maker, a tea pot, and a vase.

5. The device of claim 1, wherein the heat sensor is configured to determine when the temperature of the heating apparatus is steadily declining.

6. The device of claim 5, wherein the heat sensor and the motion sensor are configured to deactivate when the heat sensor determines that the temperature of the heating apparatus is steadily declining.

7. The device of claim 1, wherein the device is at least one of battery powered and solar powered.

8. The device of claim 1, further comprising an input interface configured to allow a user to at least one of shorten and extend a period of least one of the first countdown and the second countdown.

9. The device of claim 1, wherein the device is hangable from a ceiling.

10. The device of claim 1, further comprising a remote alarm in communication with the device configured to notify a user when the internal timer reaches the end of the second countdown.

11. The device of claim 1, wherein the device is always in an "on" state while the device is powered.

12. A device for monitoring a heating apparatus comprising:

a motion detector configured to determine whether a person is proximate the heating apparatus;

a heat sensor configured to determine whether the heating apparatus has a temperature that is above a threshold;

an internal timer in operable communication with the motion detector and the heat sensor, the internal timer configured to cyclically repeat a first countdown, and wherein the heat sensor is temporarily activated at least once during each of the repeated first countdowns, and wherein the internal timer is configured to perform a second countdown when the activated heat sensor determines that the heating apparatus has the temperature that is above the threshold, and wherein the second countdown is reset each time the motion detector determines that a person is proximate the heating apparatus; and a means in operable communication with the internal timer for notifying a user when the internal timer reaches the end of the second countdown; and wherein the internal timer is configured to stop the second countdown and revert back to the first countdown when the heat sensor determines at least one of:

that the temperature is below the threshold; and that the temperature of the heating apparatus is steadily declining.

13. The device of claim 12, further comprising an input interface configured to allow a user to at least one of shorten and extend a period of least one of the first countdown and the second countdown.

14. The device of claim 12, wherein the device is encased into a kitchen apparatus with a secondary use, wherein the kitchen apparatus is selected from the group consisting of a knife holder, a spice rack, a utensil, a clock, a coffee maker, a tea pot, and a vase.

15. The device of claim 12, wherein the heat sensor and the motion sensor are default deactivated.

16. The device of claim 12, wherein the heat sensor and the motion sensor are configured to deactivate when the heat sensor determines at least one of:

that the temperature is below the threshold; and that the temperature of the heating apparatus is steadily declining.

17. The device of claim 12, wherein the means for notifying a user when the internal timer reaches the end of the second countdown is a remote alarm.

18. The device of claim 12, wherein the device is always in an "on" state while the device is powered.

* * * * *